US005588577A

United States Patent [19]

Chen

[11] Patent Number: 5,588,577

[45] Date of Patent: Dec. 31, 1996

[54] MAGAZINE ASSEMBLY FOR PNEUMATIC STAPLE GUNS

[75] Inventor: Jacob Chen, Taichung, Taiwan

[73] Assignee: Testo Industry Corp., Taipei, Taiwan

[21] Appl. No.: 490,252

[22] Filed: Jun. 14, 1995

[51] Int. Cl.[6] ..... B25C 3/00; B25C 7/00; B25C 1/04

[52] U.S. Cl. ..... 227/120; 227/109; 227/130

[58] Field of Search ..... 227/120, 135, 227/136, 109, 130

[56] References Cited

U.S. PATENT DOCUMENTS

| | | | |
|---|---|---|---|
| 3,037,207 | 6/1962 | Pazan | 227/109 |
| 4,174,802 | 11/1979 | Maestri | 227/109 |
| 4,304,349 | 12/1981 | Novak et al. | 227/109 |
| 5,005,750 | 4/1991 | Scala | 227/109 |
| 5,054,678 | 10/1991 | Nasiatka | 227/120 |
| 5,163,596 | 11/1992 | Ravoo et al. | 227/120 |
| 5,368,213 | 11/1994 | Massari, Jr. | 227/120 |

*Primary Examiner*—Scott A. Smith
*Attorney, Agent, or Firm*—Donald C. Casey

[57] ABSTRACT

A magazine assembly for a pneumatic staple gun, including a magazine base, a mounting plate fixedly secured to the magazine base having one end covered over the bottom side of the magazine base and an opposite end connected to the gun body of the pneumatic staple gun, a magazine cover covered on the magazine base at one side, a hooked stop plate fixedly secured to the rear end of the magazine base, an end block fixedly secured to the rear end of the magazine cover, and a constraint member turned about a pivot on the end block and having a lever at one end supported on a return spring and a hook at an opposite end detachably hooked up with the hooked stop plate.

3 Claims, 8 Drawing Sheets

MAGAZINE ASSEMBLY FOR PNEUMATIC STAPLE GUNS

BACKGROUND OF THE INVENTION

Various pneumatic staple guns have been developed for driving staples into wood, etc. The magazine of a regular pneumatic staple gun, as shown in FIG. 1, is generally comprised of a magazine cover 10' and a magazine base 20'. The magazine cover 10' has a front end fixedly mounted with a stop plate 11' and a rear end fixedly mounted with an end plate 12'. The end plate 12' projects over the rear end of the magazine base 20', having a finger strip 121' at right angles. A follow plate 13' is connected to the magazine cover 10' by a spring 131' and moved in a longitudinal groove 101' on the magazine cover 10' to force staples into position for driving. A mounting plate 21' is fixedly secured to the top side of the magazine base 20' near the rear end to hold a spring plate 22' and a projecting plate 23'. By means of the mounting plate 21', the magazine base 20' is fastened to the gun body 30'. When assembled as shown in FIG. 2, the spring plate 22' is stopped at the end plate 12', causing the magazine cover 10' and the magazine base 20' firmly retained together. When to open the magazine base 20' for loading staples, the spring plate 22' is lifted from the end plate 12' as shown in FIGS. 3 and 4, then the finger strip 121' is pulled backwards by hand, causing the magazine cover 10' moved backwards relative to the magazine base 20'. When the magazine cover 10' is moved backwards relative to the magazine base 20', the stop plate 11' will be stopped by the projecting plate 23' to limit the backward movement of the magazine cover 10' relative to the magazine base 20'. When staples are loaded, the magazine cover 10' is moved forwards to its former position, permitting the spring plate 22' to stop at the end plate 12' again. This structure of magazine is still not satisfactory in function. Drawbacks of this structure of magazine is outlined hereinafter.

1) Because the magazine cover 10' and the magazine base 20' are firmly retained together by stopping the spring plate 22' at the end plate 12', when to pull the magazine cover 10' backwards from the magazine base 20', the operator shall have to lift the spring plate 22' with the forefinger and stop the finger strip 121' with the thumb. When the spring plate 22' is separated from the end plate 12', the spring plate 22' must be supported by the forefinger for permitting the magazine cover 10' to be pulled backwards by the thumb. It procedure is complicated.
2) Because the stop plate 11', the finger strip 121', the projecting plate 23', and the spring plate 22' protrude over the magazine base 20', they tend to injure the user's hands during the operation of the pneumatic staple gun. Furthermore, these protruding elements destroy the sense of beauty of the pneumatic staple gun.
3) Because the end plate 12' is made from a metal sheet by a punching machine, the hand tends to be injured by the end plate 12' when moving it.
4) The rear end of the magazine base 20' tends to deform quickly with use, causing the magazine cover 10' unable to be closely covered on the magazine base 20'.

SUMMARY OF THE INVENTION

The present invention has been accomplished to provide a magazine assembly for pneumatic staple guns which eliminates the aforesaid drawbacks. According to one aspect of the present invention, the magazine assembly comprises magazine base, a mounting plate fixedly secured to the magazine base having one end covered over the bottom side of the magazine base and an opposite end connected to the gun body of the pneumatic staple gun, a magazine cover covered on the magazine base at one side, a hooked stop plate fixedly secured to the rear end of the magazine base, an end block fixedly secured to the rear end of the magazine cover, and a constraint member turned about a pivot on the end block and having a lever at one end supported on a return spring and a hook at an opposite end detachably hooked up with the hooked stop plate. According to another aspect of the present invention, the end block has a head convenient for the holding of the hand when to pull the magazine cover backwards from the magazine base for loading staples. According to still another aspect of the present invention, the mounting plate is fixedly secured to the magazine base, having a bottom end covered over the bottom side of the magazine base and a top end connected to the gun body of the pneumatic staple gun.

DETAILED DESCRIPTION OF THE PREFERRED EMBODIMENT

Figure 1:
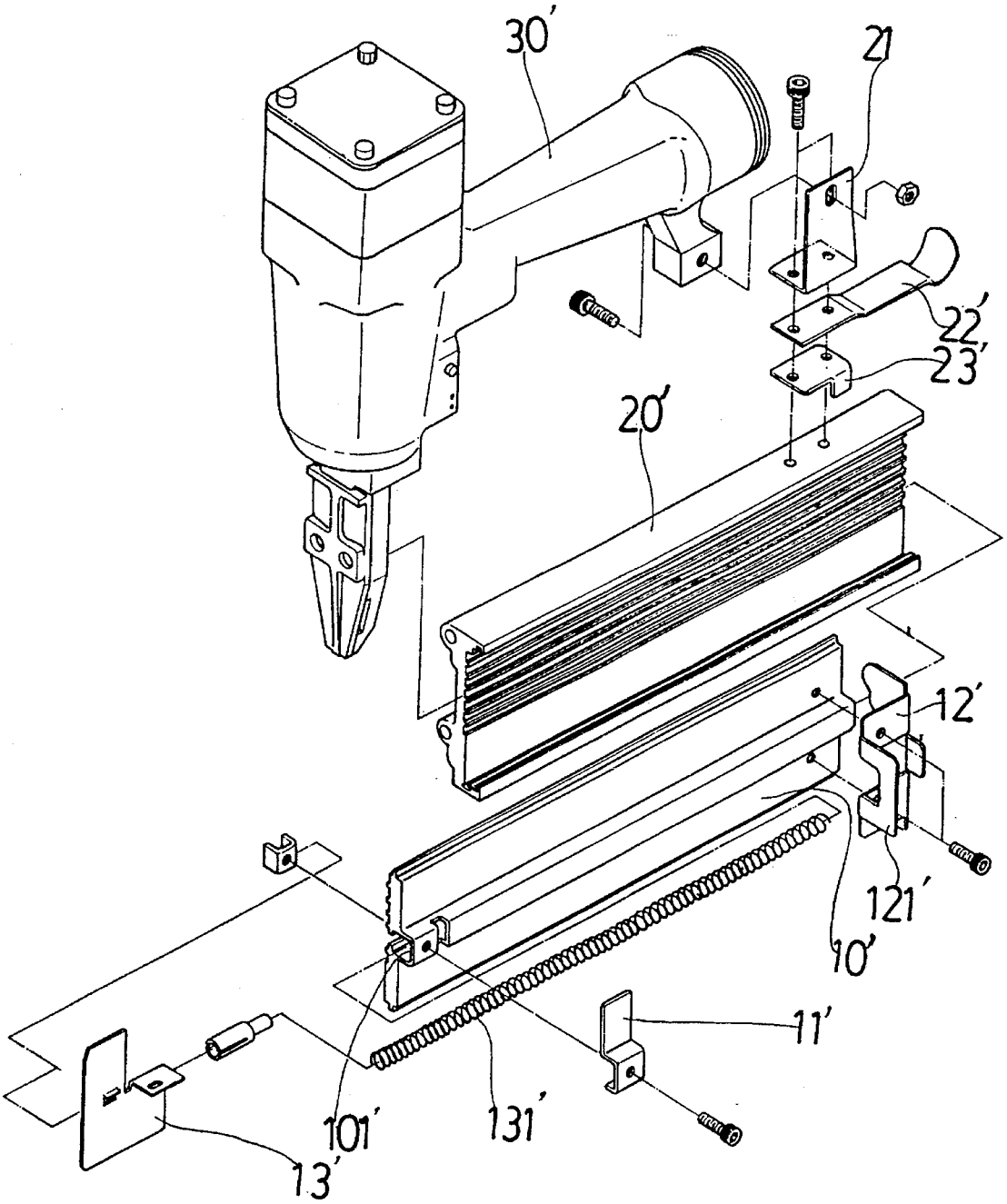
FIG. 1 (PRIOR ART)
FIG. 1 is an exploded view of a pneumatic staple gun according to the prior art.
Figure 2:
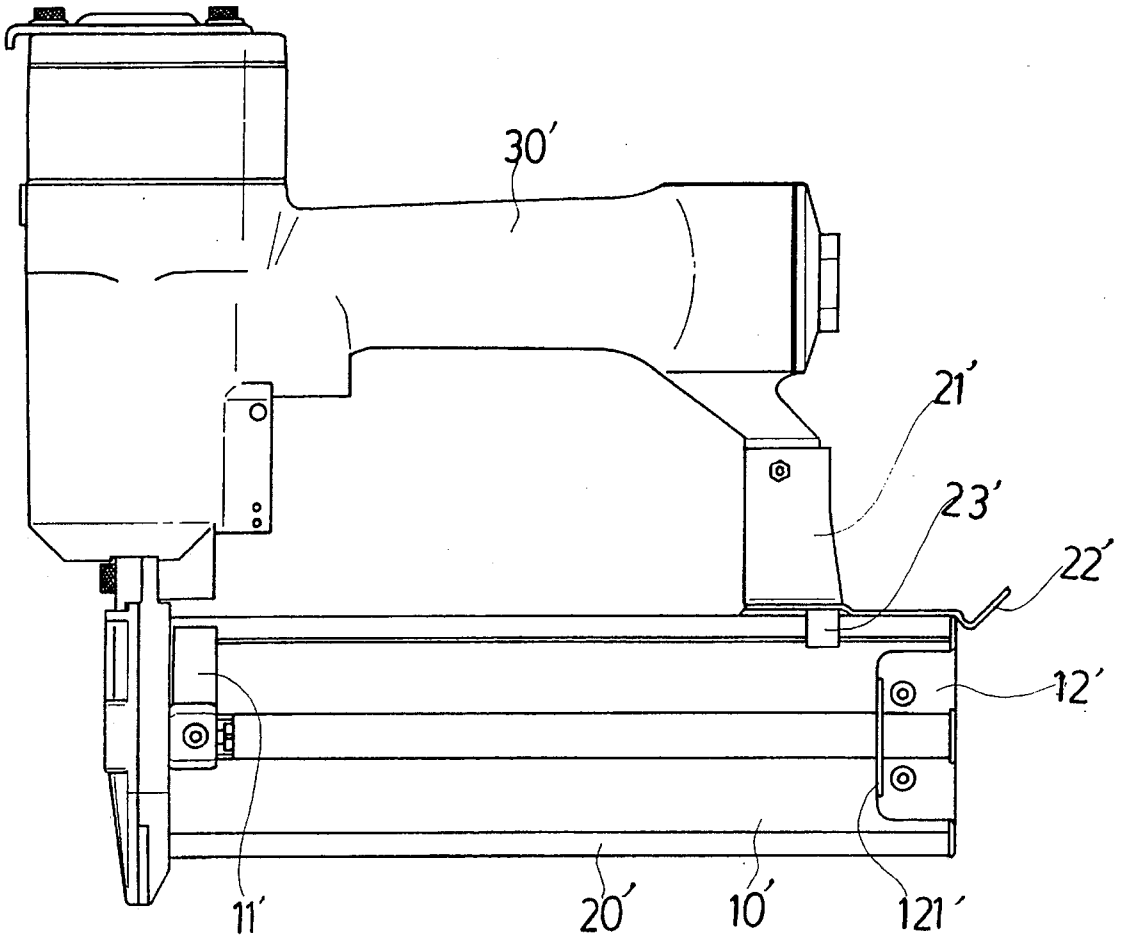
FIG. 2 (PRIOR ART)
FIG. 2 is an assembly view of the staple gun shown in FIG. 1.
Figure 3:
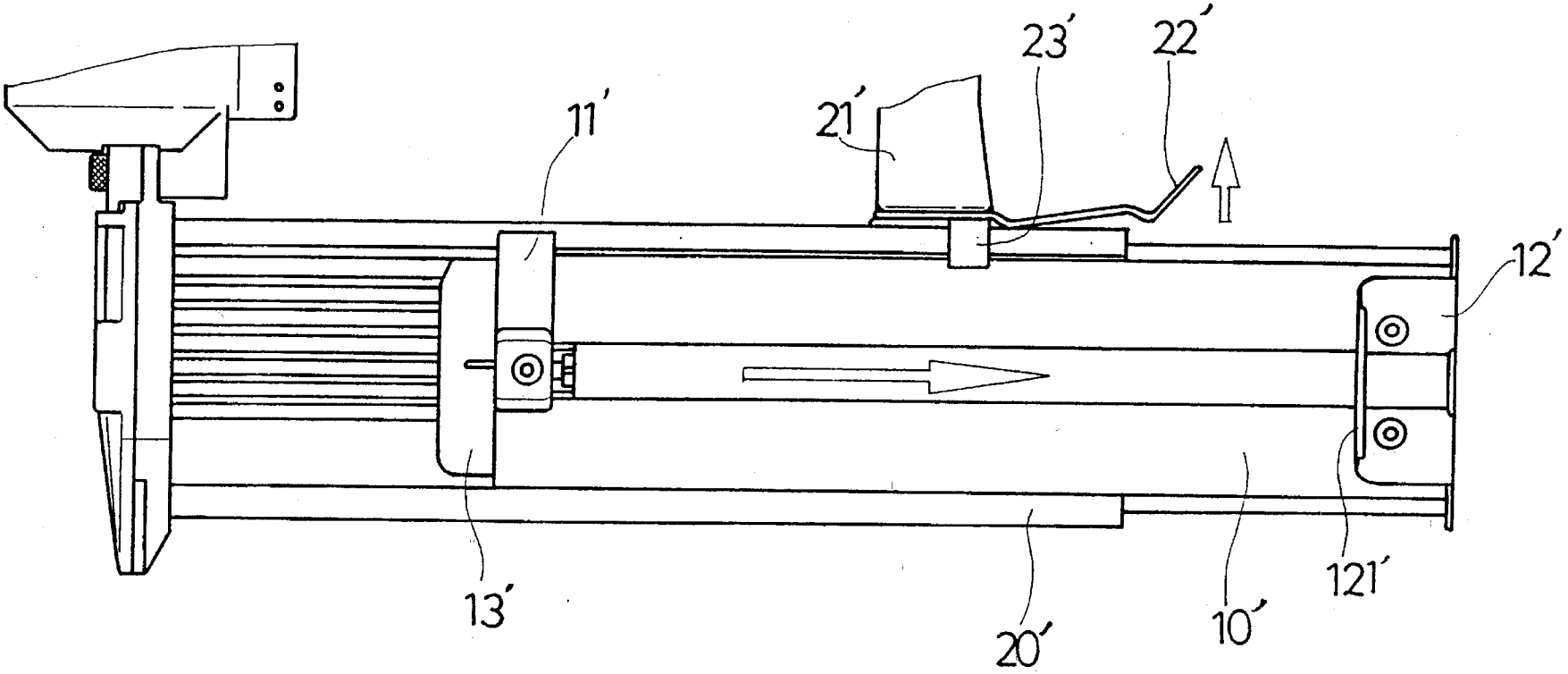
FIG. 3 (PRIOR ART)
FIG. 3 shows the magazine cover of the staple gun of FIG. 2 pulled backwards from the magazine base.
Figure 4:
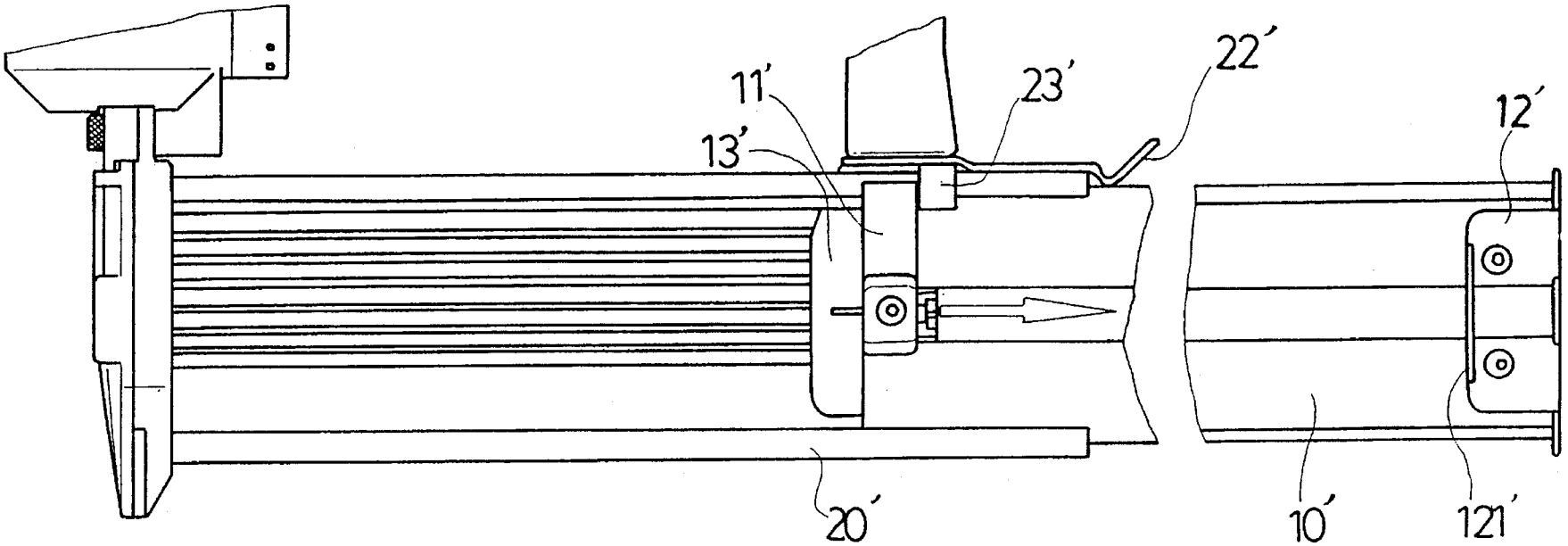
FIG. 4 (PRIOR ART)
FIG. 4 is similar to FIG. 3 but showing the stop plate of the magazine cover stopped against the projecting plate of the magazine base.
Figure 5:
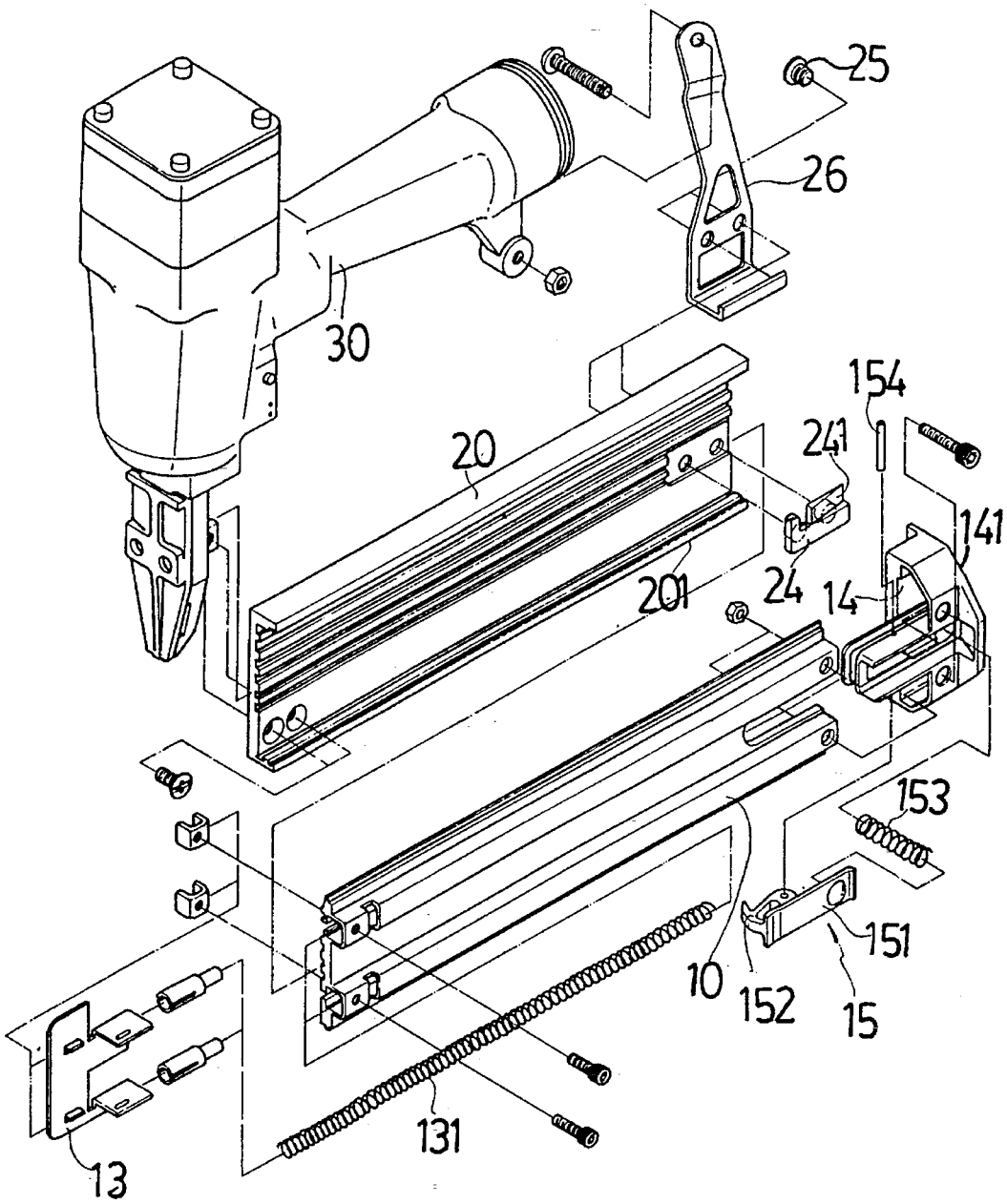
FIG. 5 is an exploded view of a pneumatic staple gun according to the present invention.
Figure 6:
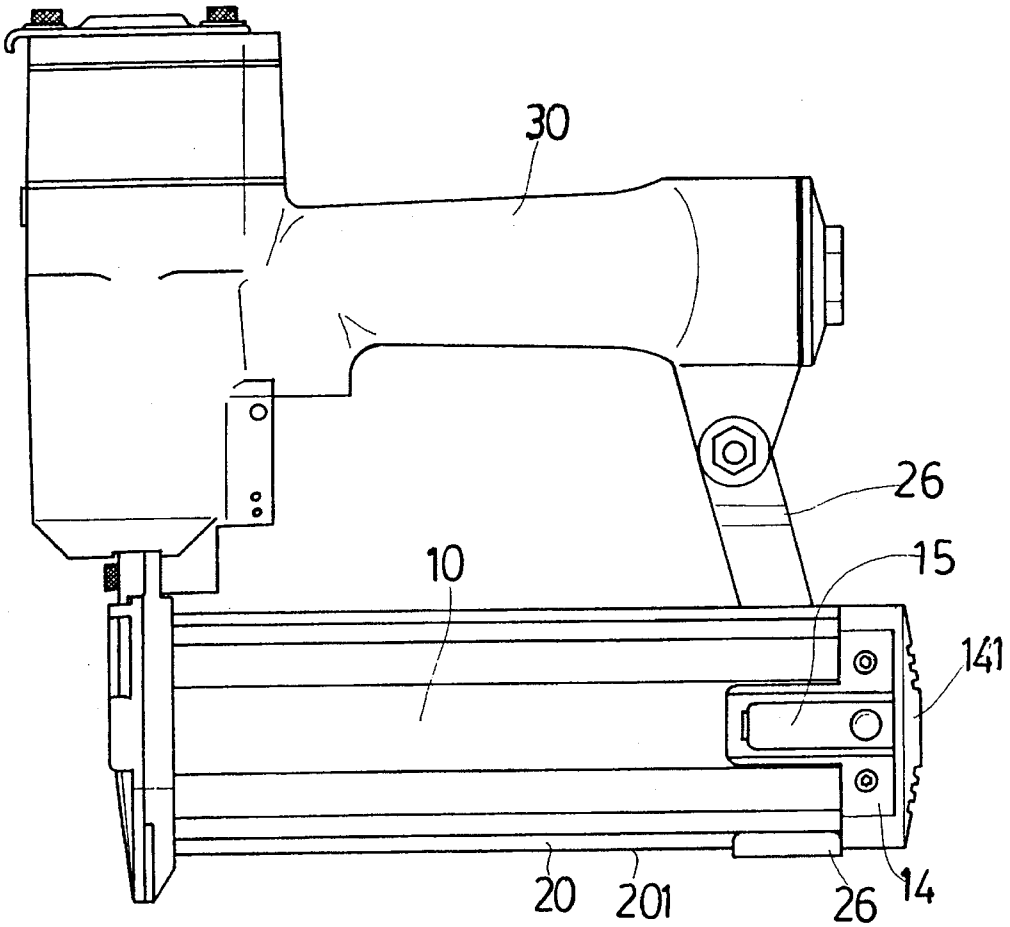
FIG. 6 is an assembly view of the pneumatic staple gun shown in FIG. 5.

Referring to FIGS. 5 and 6, the magazine cover 10 has a rear end connected with an end block 14. The end block 14 comprises a head 141. A constraint member 15 is turned about a pivot 154 on the end block 14, having a lever 151 at one end supported on a return spring 153, which is secured to the end block 14, and a hook 152 at an opposite end. The magazine base 20 has a rear end fixedly mounted with a hooked stop plate 24 at one side and a mounting plate 26 at an opposite side. The mounting plate 26 is fixedly secured to the magazine base 20 by fastening elements 25, having one end covered over the bottom side 201 of the magazine base 20 and an opposite end fixedly secured to the gun body 30. The hooked stop plate 24 has a guide slope 241 for guiding the hook 152 of the constraint member 15 into engagement with the hooked stop plate 24. When the magazine cover 10 and the magazine base 20 are connected together, the hook 152 of the constraint member 15 hooks up with the hooked stop plate 24. Therefore, the magazine cover 10 and the magazine base are firmly retained together.

Figure 7:
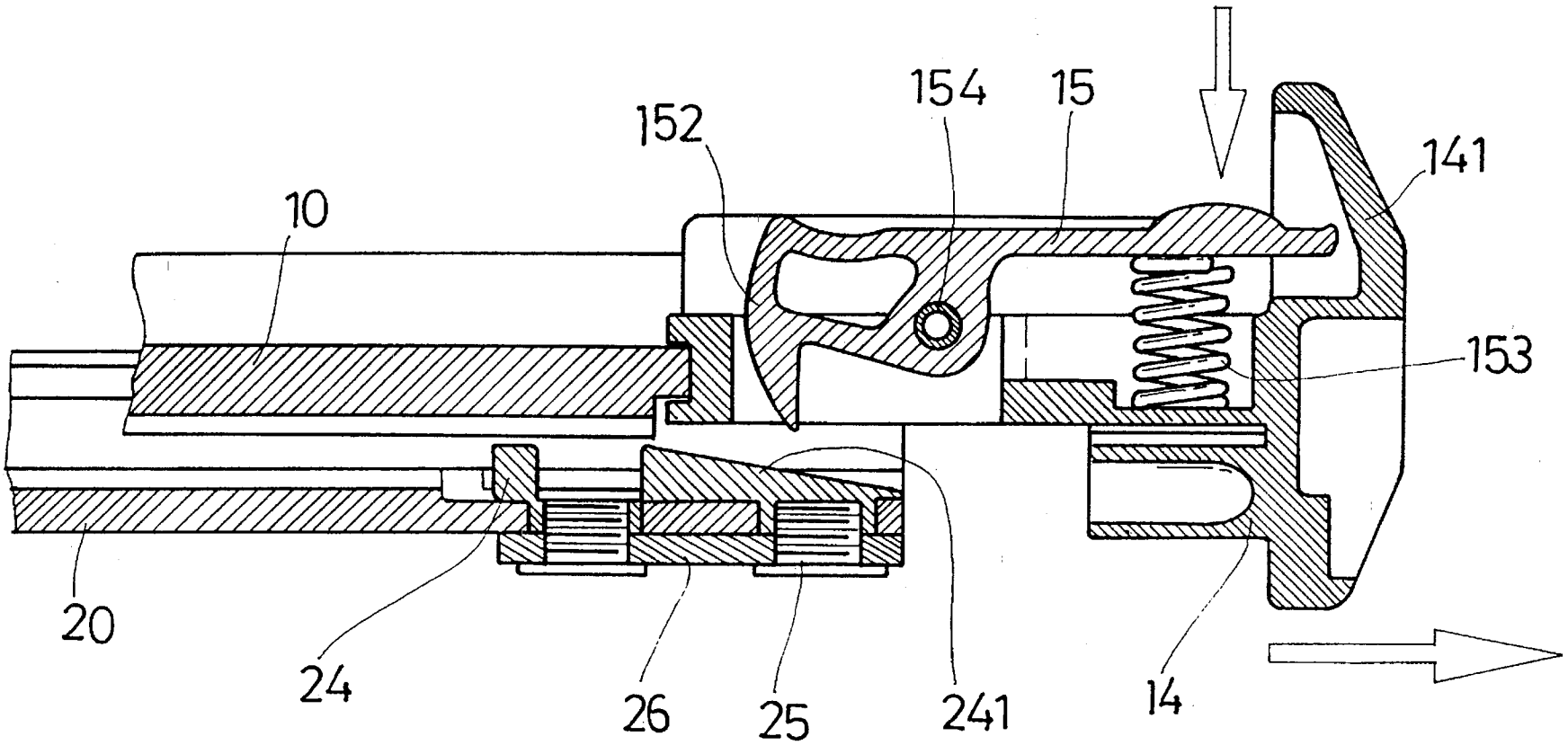
FIG. 7 is a longitudinal view in section of the magazine assembly shown in FIG. 5, showing the magazine cover pulled backwards from the magazine base.

Referring to FIG. 7, when the lever 151 is depressed to compress the return spring 153, the hook 152 is disengaged from the hooked stop plate 24, and therefore the magazine cover 10 can be pulled backwards from the magazine base 20 by holding the head 141 of the end block 14 with the hand and then pulling it backwards.

Figure 8:
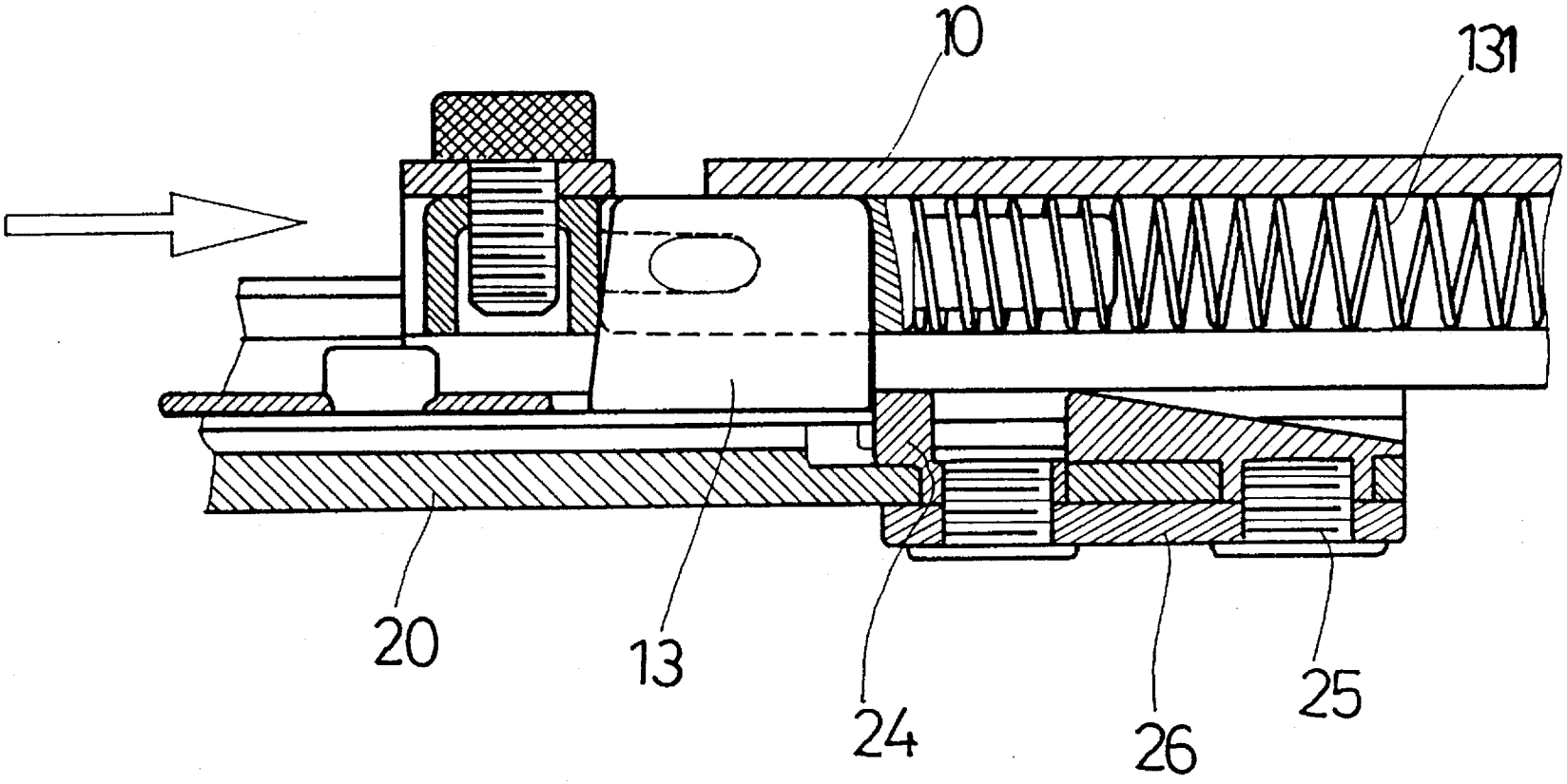
FIG. 8 is a partial view in section of the magazine assembly shown in FIG. 5, showing the follow plate stopped at the hooked stop plate.

Referring to FIG. 8, when the magazine cover 10 is pulled backwards from the magazine base 20, the follow plate 13 which is connected to the magazine base 20 by a spring 131 will be stopped by the hooked stop plate 24 to limit the backward movement of the magazine cover 10 relative to the magazine base 20, and therefore the magazine cover 10 does not disconnect from the magazine base 20.

As indicated above, the magazine cover 10 can be pulled out of the magazine base 20 when the lever 151 is depressed to surpass the spring force of the return spring 153. Because the mounting plate 26 is partially covered over the bottom side 201 of the magazine base 20, the structural strength of the magazine base 20 is reinforced.

It is to be understood that the drawings are designed for purposes of illustration only, and are not intended as a definition of the limits and scope of the invention disclosed.

I claim:

1. A magazine assembly for a pneumatic staple gun, comprising a magazine base, a mounting plate fixedly secured to said magazine base for connecting said base to a gun body of the pneumatic staple gun, a magazine cover covering on said magazine base at one side, and a follow plate connected to said magazine cover by a spring for forcing staples into position for driving, wherein said magazine cover has a rear end connected with an end block and a constraint member, said end block having a head for being grapsed by the hand of an operator to pull said magazine cover backwards from said magazine base, said constraint member having a hook and being turned about a pivot on said end block for hooking up said magazine cover in position; said magazine base has a rear end fixedly mounted with a hooked stop plate at one side, said hooked stop plate having a guide slope for guiding the hook of said constraint member into engagement with said hooked stop plate when said magazine cover is covering on said magazine base.

2. The magazine assembly of claim 1 wherein said constraint member has a lever at one end supported on a return spring, which is secured to said end block, and said hook at an opposite end for hooking up with said hooked stop plate.

3. The magazine assembly of claim 1 wherein said mounting plate is fixedly secured to said magazine base, having one end covering a lowest edge of said magazine base and an opposite end connected to the gun body of the pneumatic staple gun.

* * * * *